US009617091B2

(12) United States Patent
Matsuo et al.

(10) Patent No.: US 9,617,091 B2
(45) Date of Patent: Apr. 11, 2017

(54) FEEDING DEVICE AND IMAGE FORMING DEVICE

(71) Applicant: CANON KABUSHIKI KAISHA, Tokyo (JP)

(72) Inventors: Takamichi Matsuo, Suntou-gun (JP); Koji Kawamura, Susono (JP); Shoichi Zensai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/726,250

(22) Filed: May 29, 2015

(65) Prior Publication Data

US 2015/0344245 A1 Dec. 3, 2015

(30) Foreign Application Priority Data

Jun. 3, 2014 (JP) ..... 2014-115303

(51) Int. Cl.
*B65H 3/06* (2006.01)
*B65H 1/26* (2006.01)

(52) U.S. Cl.
CPC ..... *B65H 1/266* (2013.01); *B65H 3/0669* (2013.01); *B65H 3/0684* (2013.01); *B65H 2403/53* (2013.01); *B65H 2403/541* (2013.01); *B65H 2403/721* (2013.01); *B65H 2601/324* (2013.01)

(58) Field of Classification Search
CPC ..... B65H 3/0684; B65H 2405/324; B65H 2601/324
See application file for complete search history.

(56) References Cited

U.S. PATENT DOCUMENTS 5,709,380 A * 1/1998 Petocchi ..... B65H 3/5261 271/117
6,969,058 B2 * 11/2005 Gaarder ..... B65H 3/0669 271/10.04
7,025,345 B2 * 4/2006 Frazier ..... B65H 3/06 271/109
7,905,479 B2 * 3/2011 Samoto ..... B65H 3/0684 271/117
7,992,859 B2 * 8/2011 Shiina ..... G03G 15/6511 271/109
8,079,586 B2 * 12/2011 Watanabe ..... B65H 3/0638 271/145
8,196,917 B2 * 6/2012 Shiba ..... B65H 7/02 271/10.03
8,262,084 B2 * 9/2012 Nishikata ..... B65H 3/0638 271/145
8,439,353 B2 * 5/2013 Tamehira ..... B65H 3/0684 271/121

(Continued)

FOREIGN PATENT DOCUMENTS

JP 2004-256287 A 9/2004
JP 2009-269696 A 11/2009
JP 2009-286594 A 12/2009

*Primary Examiner* — Jeremy R Severson
(74) *Attorney, Agent, or Firm* — Canon U.S.A. Inc., IP Division

(57) ABSTRACT

Interlocked with an operation in which a feeding cassette is drawn out from a main body of a device, a restriction rib moves to a permissive position from a restrictive position, and interlocked with an operation in which the feeding cassette is inserted into the main body of the device, the restriction rib moves to the restrictive position from the permissive position.

7 Claims, 9 Drawing Sheets

(56) References Cited

U.S. PATENT DOCUMENTS

| | | | | |
|---|---|---|---|---|
| 8,534,664 | B2 * | 9/2013 | Yamamoto | B65H 3/5223 271/110 |
| 8,857,811 | B2 * | 10/2014 | Kakuta | B65H 1/00 271/121 |
| 8,894,061 | B2 * | 11/2014 | Matsuoka | B65H 5/06 271/10.13 |
| 8,939,446 | B2 * | 1/2015 | Ichikawa | B65H 3/0638 271/109 |
| 2015/0329303 | A1 * | 11/2015 | Xie | B65H 5/068 271/273 |

* cited by examiner

FEEDING DEVICE AND IMAGE FORMING DEVICE

BACKGROUND OF THE INVENTION

Field of the Invention

The present disclosure relates to a feeding device and an image forming device.

Description of the Related Art

Image forming devices such as a printer and a copying machine are provided with a feeding device that includes a feeding cassette and a feed roller that feeds a sheet contained in the feeding cassette. The feed roller is formed of a fiction material such as rubber, and when feeding the sheet, the feed roller abuts against the sheet and rotates to feed the sheet contained in the feeding cassette to an image forming portion.

In the feeding device having such a configuration, when the rubber of the feed roller becomes deteriorated due to wear and the like, deterioration in the feeding performance may disadvantageously occur. Accordingly, feeding devices in which, in order to enable the feed roller to be replaced, a feed roller is made detachable from a main body of the device are known (Japanese Patent Laid-Open No. 2004-256287 and Japanese Patent Laid-Open No. 2009-269696).

Japanese Patent Laid-Open No. 2004-256287 describes a configuration which, in order to facilitate replacement work of a feed roller, enables the feed roller to be replaced by sliding the feed roller in the axial direction. Furthermore, Japanese Patent Laid-Open No. 2009-286594 describes a configuration provided with a lock member capable of being moved between a lock position where the feed roller is restricted from being detached and a permissive position where the feed roller is permitted to be detached.

Note that the replacement of the feed roller is performed while in a state in which the feeding cassette is drawn out.

Furthermore Japanese Patent Laid-Open No. 2009-269696 discloses a case in which the feed roller is restricted from being detached by a height restriction member that prevents over-stacking. Furthermore, Japanese Patent Laid-Open No. 2009-269696 discloses a case in which the height restriction member moves between a restrictive position and a retreat position while being interlocked with the attaching and detaching operation of the cassette.

However, in the configuration described in Japanese Patent Laid-Open No. 2004-256287, the feed roller may disadvantageously come off from the main body of the device while in a state in which the feeding cassette is inserted into the main body of the device. Specifically, during transportation of the device and during jam recovery, due to an unexpected force applied to the roller, disadvantageously, the feed roller may be slid and come off from the main body of the device.

Meanwhile, the configuration described in Japanese Patent Laid-Open No. 2009-286594 includes a lock member; accordingly, there is little possibility of the feed roller coming off during transportation and jam recovery. However, when replacing the feed roller, the user needs to move the lock member from the lock position to the lock release position; accordingly, work when replacing the feed roller is disadvantageously increased.

Furthermore, in the configuration described in Japanese Patent Laid-Open No. 2009-269696, the height restriction member needs to be moved between the restrictive position and the retreat position, thus, leading to complication of the configuration in some cases.

SUMMARY OF THE INVENTION

Accordingly, the present disclosure provides a feeding device and an image forming device in which a feed roller is prevented from coming off from a main body of the device other than when replacing the feed roller, and in which usability is improved when replacing the feed roller.

In an aspect of the present disclosure, a feeding device that feeds a sheet includes a support unit, a stacking unit, on which a sheet is stacked, provided so as to be capable of being inserted into and drawn out from the support unit, a feed roller that feeds a sheet stacked on the stacking unit, and a holding member that holds the feed roller, the holding member provided so as to be capable of being detached from the support unit by being moved in a predetermined direction. In the feeding device, interlocked with an operation in which the stacking unit is drawn out from the support unit, the holding member moves to a second position from a first position such that the feed roller is lifted up, and interlocked with an operation in which the stacking unit is inserted into the support unit, the holding member moves to the first position from the second position such that the feed roller is lowered. The holding member includes a restriction portion that restricts the holding member from moving in the predetermined direction, and in a state in which the holding member is positioned at the first position, the restriction portion is positioned at a restrictive position where the holding member is restricted from moving in the predetermined direction, and in a state in which the holding member is positioned at the second position, the restriction portion is positioned at a permissive position where the holding member is permitted to move in the predetermined direction.

Further features of the present invention will become apparent from the following description of exemplary embodiments with reference to the attached drawings.

DESCRIPTION OF THE EMBODIMENTS

First Exemplary Embodiment

Hereinafter, an electrophotographic type color laser beam printer (an image forming device) of a first exemplary embodiment to which the present disclosure has been applied will be described with reference to the drawings. Note that the dimensions, the materials, the shapes of the components and the relative configuration of the components, and the like that are described in the following exemplary embodiments are to be appropriately changed based on the device to which the present disclosure is applied and on various conditions. Accordingly, unless otherwise specified in particular, the present disclosure is not to be limited by the exemplary embodiments described below.

Figure 1:
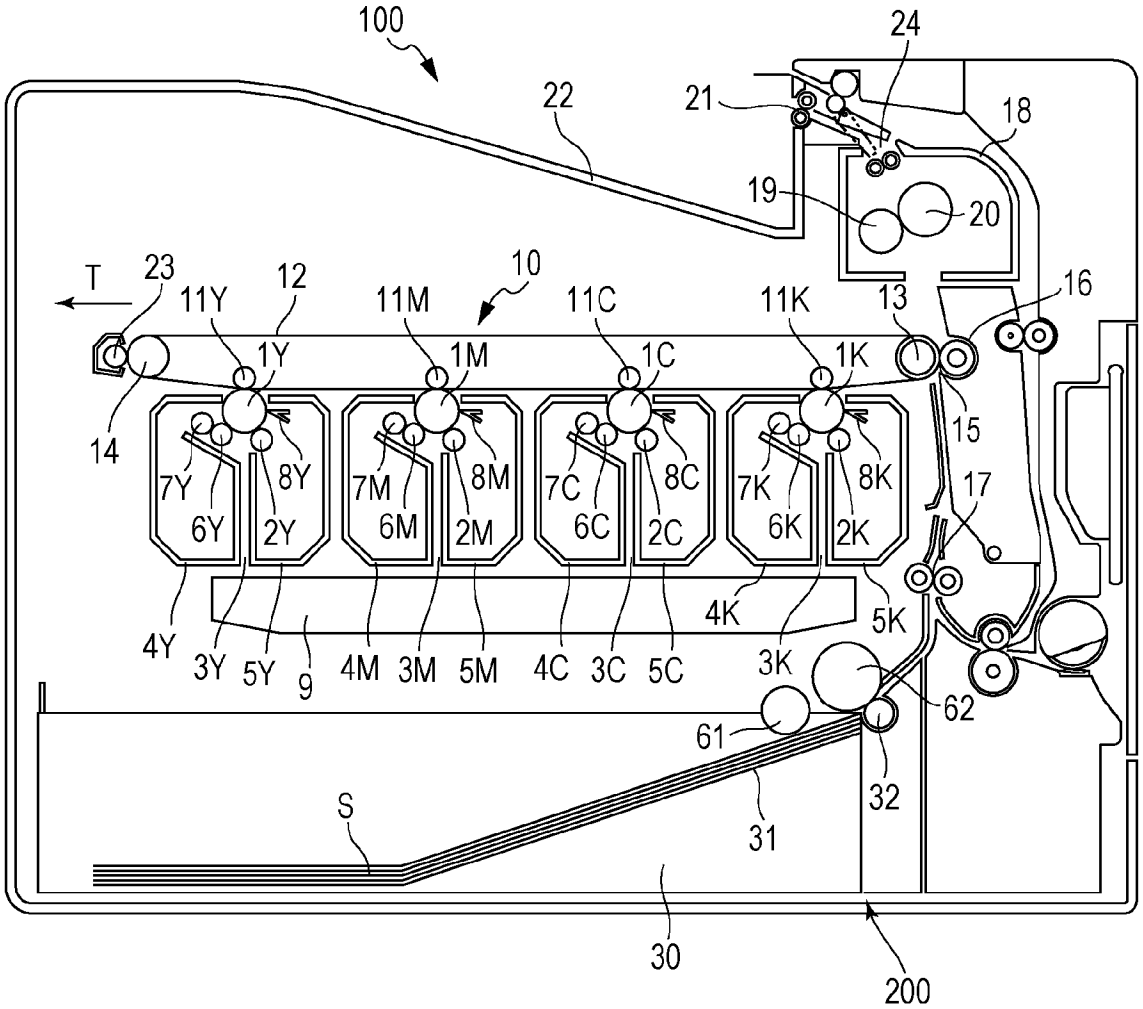
FIG. 1 is a cross-sectional view of an image forming device of a first exemplary embodiment.

Referring first to FIG. 1, the overall configuration of the image forming device will be described. FIG. 1 is a schematic front cross-sectional view of the image forming device.

An image forming device 100 illustrated in FIG. 1 is provided with process cartridges 3Y, 3M, 3C, and 3K that are detachable with respect to a main body of the device. While the four process cartridges 3Y, 3M, 3C, and 3K have the same structure, the four process cartridges 3Y, 3M, 3C, and 3K are different from each other in that images are formed with toners with different colors, namely, yellow (Y), magenta (M), cyan (C), and black (K). Process cartridges 3Y, 3M, 3C, and 3K includes developing units 4Y, 4M, 4C, and 4K and cleaner units 5Y, 5M, 5C, and 5K. Among the above, the former developing units 4Y, 4M, 4C, and 4K include development rollers 6Y, 6M, 6C, and 6K, toner applying rollers 7Y, 7M, 7C, and 7K, and a toner container. Meanwhile, the latter cleaner units 5Y, 5M, 5C, and 5K include photosensitive drums 1Y, 1M, 1C, and 1K that are image carrying members, charge rollers 2Y, 2M, 2C, and 2K, drum cleaning blades 8Y, 8M, 8C, and 8K, and a waste toner container. A scanner unit 9 is disposed vertically under the process cartridges 3Y, 3M, 3C, and 3K. The photosensitive drums 1Y, 1M, 1C, and 1K are exposed according to image signals. The photosensitive drums 1Y, 1M, 1C, and 1K are charged with a potential having a predetermined negative polarity with the charge rollers 2Y, 2M, 2C, and 2K, and the scanner unit 9 forms an electrostatic latent image on each of the photosensitive drums 1Y, 1M, 1C, and 1K. The electrostatic latent images are reversely developed with the developing units 4Y, 4M, 4C, and 4K. In other words, toners having a negative polarity are adhered to the photosensitive drums 1Y, 1M, 1C, and 1K such that toner images of yellow, magenta, cyan, and black are formed on each of the photosensitive drums.

An intermediate transfer belt unit 10 includes an intermediate transfer belt 12, and a driving roller 13 and a tension roller 14 that stretch the intermediate transfer belt 12. The tension roller 14 applies tension to the intermediate transfer belt 12 in an arrow T direction. Each of the photosensitive drums 1Y, 1M, 1C, and 1K rotates in the clockwise direction in FIG. 1 and the intermediate transfer belt 12 rotates in the anticlockwise direction. Furthermore, primary transfer rollers 11Y, 11M, 11C, and 11K are provided inside the intermediate transfer belt 12 and at a position opposing the photosensitive drums 1Y, 1M, 1C, and 1K. Each of the primary transfer rollers 11Y, 11M, 11C, and 11K is configured to apply a transfer bias with a bias application unit (not shown).

By applying a bias having a positive polarity to the primary transfer rollers 11Y, 11M, 11C, and 11K, the toner images are primarily transferred onto the intermediate transfer belt 12 from the toner image on the photosensitive drum 1Y in a sequential manner such that toner images of four colors are conveyed to a secondary transfer portion 15 while overlapping each other.

A sheet S that is fed from a feeding device 200 described later is conveyed to the secondary transfer portion 15 with a pair of registration rollers 17. In the secondary transfer portion 15, by applying a bias having a positive polarity to a secondary transfer roller 16, the toner images of four colors on the intermediate transfer belt 12 are secondarily transferred onto the conveyed sheet S.

The toners remaining on the surfaces of the photosensitive drums 1Y, 1M, 1C, and 1K are removed by the drum cleaning blades 8Y, 8M, 8C, and 8K. Furthermore, the toners remaining on the intermediate transfer belt 12 after the secondarily transfer onto the sheet S has been performed are removed by an intermediate transfer belt cleaning device 23 and are collected into a waste toner collecting container (not shown).

The sheet S on which the toner images have been transferred is conveyed to a fixing unit 18 and is heated and compressed by a fixing roller 19 and a pressure roller 20. With the above, the toner images are fixed on the surface of the sheet S. Decurling rollers 24 disposed downstream of the fixing roller 19 and the pressure roller 20 reduce the curl of the sheet S after the fixing process. The sheet S that has been conveyed from the decurling rollers 24 is conveyed to discharge rollers 21 and is discharged onto a discharge tray 22.

Figure 2A:
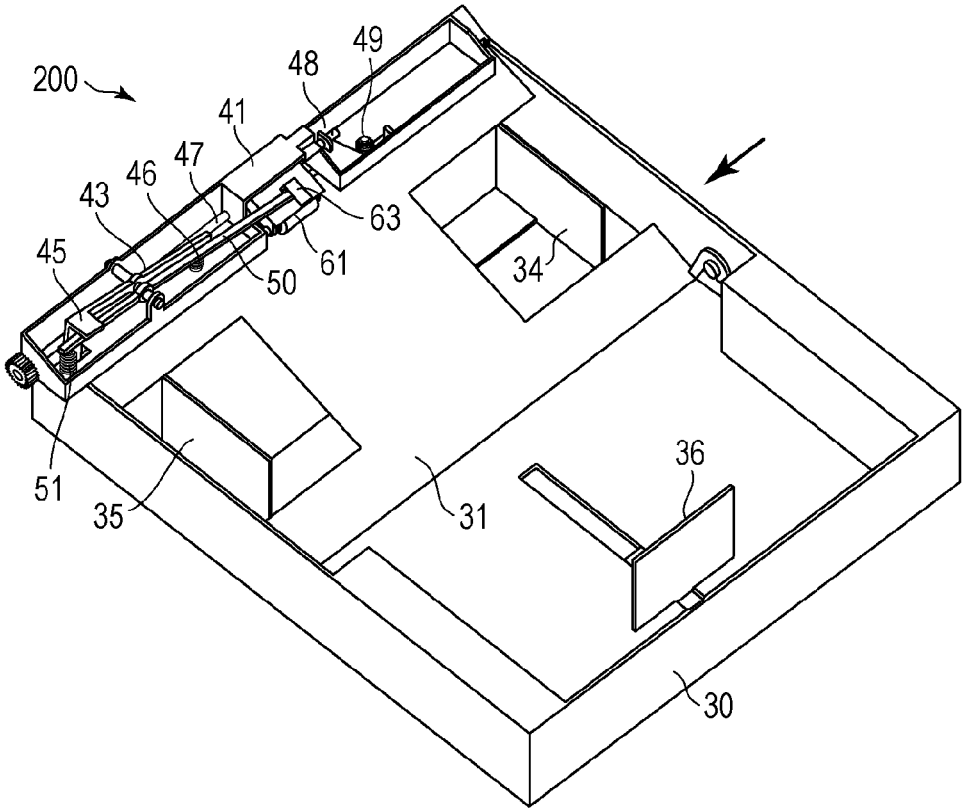
FIG. 2A is a perspective view of a feeding device of the first exemplary embodiment.
Figure 2B:
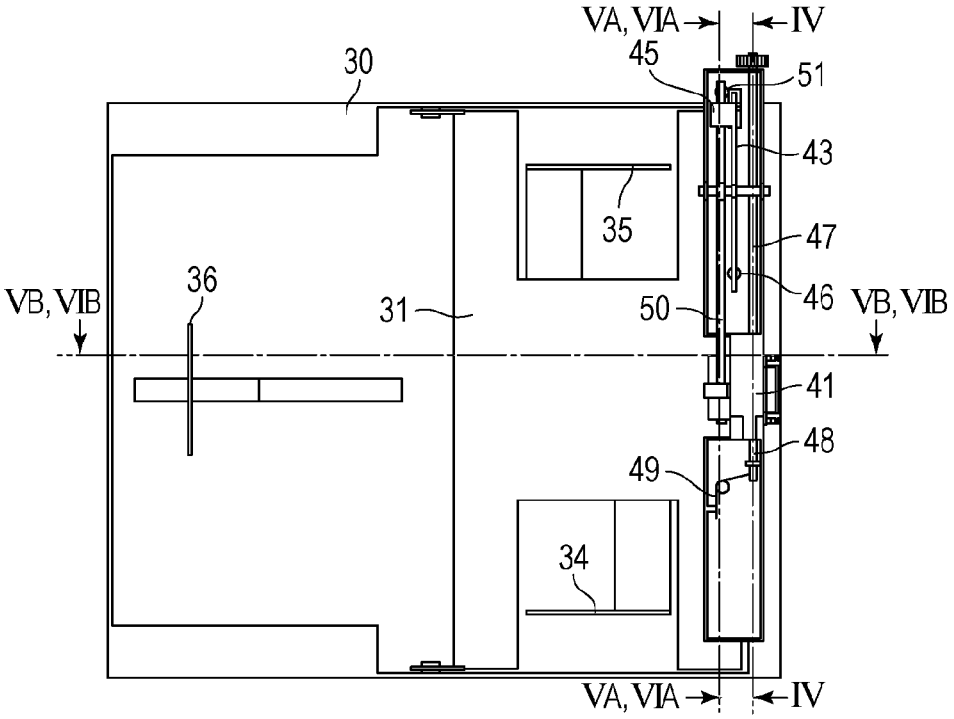
FIG. 2B is a top view of the feeding device of the first exemplary embodiment.

FIGS. 2A and 2B each illustrate a schematic diagram of the feeding device 200 of the first exemplary embodiment.

The feeding device 200 feeds the sheet S to an image forming portion that forms an image on the sheet S. The feeding device 200 includes a body side feed unit 40 that is attached to the image forming device (the main body of the device) 100, a feed drive unit (not shown), and a feeding cassette (a stacking unit) 30 that can be mounted in (inserted into) and drawn out from the image forming device (the main body of the device and a support unit) 100.

The direction in which the feeding cassette 30 is inserted into the image forming device 100 is the direction of the arrow in FIG. 2A. A stack plate 31 on which the sheet S is stacked is provided in the feeding cassette 30. The stack plate 31 is provided in a swingable manner so as to swing according to the stacked amount of the sheet S. A pickup roller (a feed roller) 61 feeds the sheet S stacked on the stack plate 31. Note that the direction in which the pickup roller 61 feeds the sheet S is a direction orthogonal to the direction in which the feeding cassette 30 is inserted into and drawn out from the image forming device 100.

The position of the sheet S stacked on the stack plate 31 in the front-rear direction of the main body of the device (the width direction which is a direction that is orthogonal to the feed direction) is restricted by a front-side side restriction plate 34 and a rear-side side restriction plate 35. The rear end portion of the sheet S in the feed direction is restricted by a rear end restriction plate 36.

In feeding the sheet S that is contained in the feeding cassette 30, the stack plate 31 moves up until the pickup roller 61 and the sheet S abut against each other. Upon transmission of drive from the feed drive unit, the pickup roller 61 rotates and feeds the sheet S to a feed roller 62. The sheet S is conveyed to the pair of registration rollers 17 with the feed roller 62. The pair of registration rollers 17 performs skew correction of the sheet S, and the sheet S is conveyed towards the secondary transfer portion 15 at a timing matching the formation of the image.

A roller holder (a holding member) 63 holds the pickup roller 61 and the feed roller 62. Furthermore, the roller holder 63 is provided so as to be swingable (pivotal) about a feed shaft 47. The roller holder 63 pivots while interlocking with the attaching and detaching operation of the feeding cassette 30.

A separation roller 32 is provided in the feeding cassette 30 and at a position opposing the feed roller 62. When the pickup roller 61 picks up (feeds) a plurality of sheets S at the same time, the sheets S are separated, sheet by sheet, with the separation roller 32 and are conveyed towards the pair of registration rollers 17.

Figure 3:
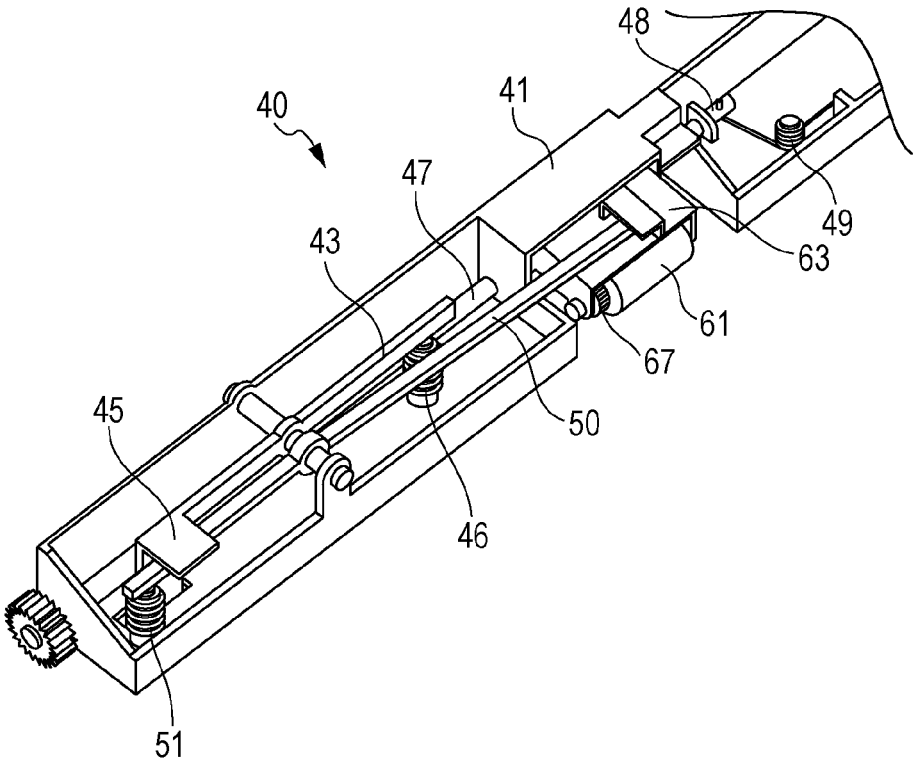
FIG. 3 is a perspective view of a body side feed unit.

FIG. 3 is a perspective view of the body side feed unit 40 in a state in which the feeding cassette 30 is drawn out. The body side feed unit 40 includes a feed frame 41 and a feed roller unit (a feed unit) 60. With a swing lever 50, the feed roller unit 60 is provided so as to be swingable (pivotal) in the up-down direction. The feed frame 41 is secured to the image forming device 100, and the feed roller unit 60 is attached to the feed frame 41 in a detachable manner. In other words, the feed roller unit 60 is provided so as to be capable of being detached from the main body of the device. In the first exemplary embodiment, when the pickup roller 61 has become worn due to being used for a long period, the user can detach the feed roller unit 60 from the main body of the device and attach a new feed roller unit 60 to the main body of the device. Note that in the present disclosure, the feed roller unit 60 may be configured such that only the pickup roller 61 is replaced from the detached feed roller unit 60.

Figure 6A:
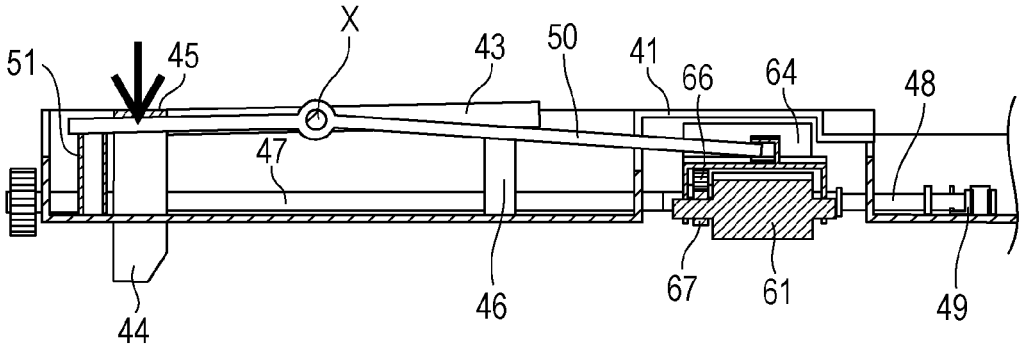
FIG. 6A is a partial sectional view taken in the VIA-VIA direction in FIG. 2B and illustrates a state in which the feeding cassette is drawn out from the main body of the device.
Figure 6B:
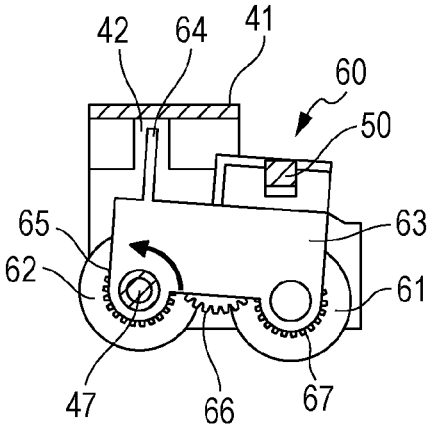
FIG. 6B is a partial cross-sectional view taken in the VIB-VIB direction in FIG. 2B and illustrates the state in which the feeding cassette is drawn out from the main body of the device.

As illustrated in FIG. 6B, the feed roller unit 60 includes the pickup roller 61, the feed roller 62, and the roller holder 63 that holds the pickup roller 61 and the feed roller 62. When feeding the sheet S, drive from the feed drive unit is transmitted to the feed shaft 47, and the feed roller 62 that is locked to the feed shaft 47 rotates. When the feed roller 62 rotates, a feed gear 65 that is locked to the feed roller 62 in a coaxial manner with respect to the feed roller 62 rotates as well. The feed gear 65 is meshed with the idler gear 66, and a pick gear 67 that is engaged with the idler gear 66 rotates as well. When the pick gear 67 rotates, the pickup roller 61 that is locked to the pick gear 67 in a coaxial manner rotates as well.

Figure 4A:
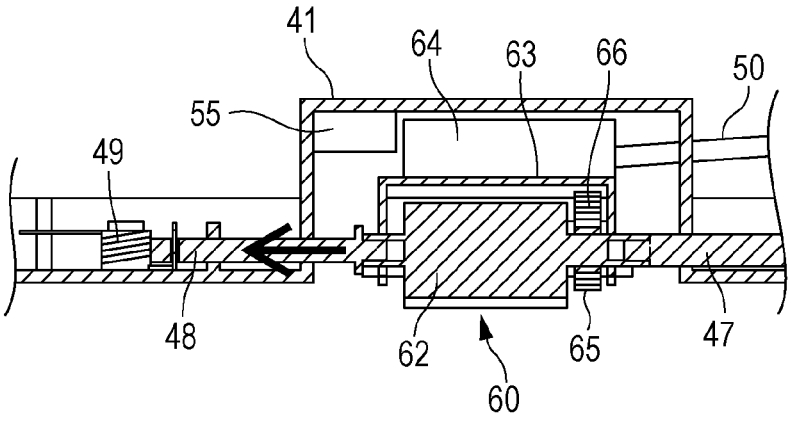
FIG. 4A is a partial sectional view taken in the IV-IV direction in FIG. 2B and illustrates a state in which a feed roller unit is attached.
Figure 4B:
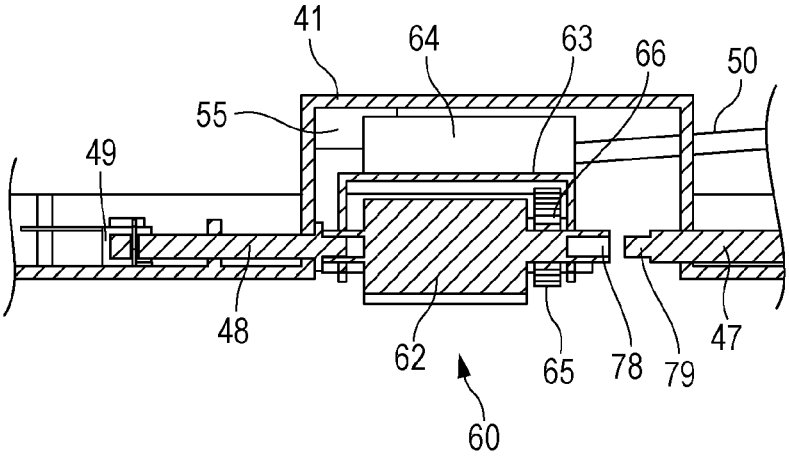
FIG. 4B is a partial sectional view taken in the IV-IV direction in FIG. 2B and illustrates a state in which a lock between the feed roller unit and a feed shaft has been released.

FIGS. 4A and 4B are sectional views taken in the IV-IV direction in FIG. 2B and are diagrams illustrating the action taken when performing an attaching and detaching operation of the feed roller unit 60. The feed roller unit 60 is held by the feed shaft 47 that is a rotating shaft of the feed roller 62 and by a slide shaft 48. The slide shaft 48 is elastically biased towards the feed roller 62 side (a direction opposite to the direction of the arrow in FIG. 4A) with a slide spring 49. The slide shaft 48 is provided so as to be capable of moving in the axial direction (the direction of the arrow in FIG. 4A) while countering the elastic force of the slide spring 49.

When detaching the feed roller unit 60 from the feed frame 41, the user pushes the feed roller unit 60 in the direction of the arrow in FIG. 4A so as to counter the elastic force of the slide spring 49 and moves the slide shaft 48. Then, as illustrated in FIG. 4B, the locked state between a recess 78 of the feed roller unit 60 and a protrusion 79 of the feed shaft 47 is canceled. With the above, the feed roller unit 60 can be removed from the body side feed unit 40. In other words, by moving the feed roller unit 60 in the axial direction (a predetermined direction) of the pickup roller 61, the feed roller unit 60 can be detached from the main body of the device.

When attaching the feed roller unit 60 to the feed frame 41, the user inserts the feed roller unit 60 into the slide shaft 48 such that a state illustrated in FIG. 4B is created. Subsequently, the user moves the feed roller unit 60 in a direction opposite to the direction of the arrow in FIG. 4A and locks the feed roller unit 60 and the feed shaft 47 to each other.

Figure 5A:
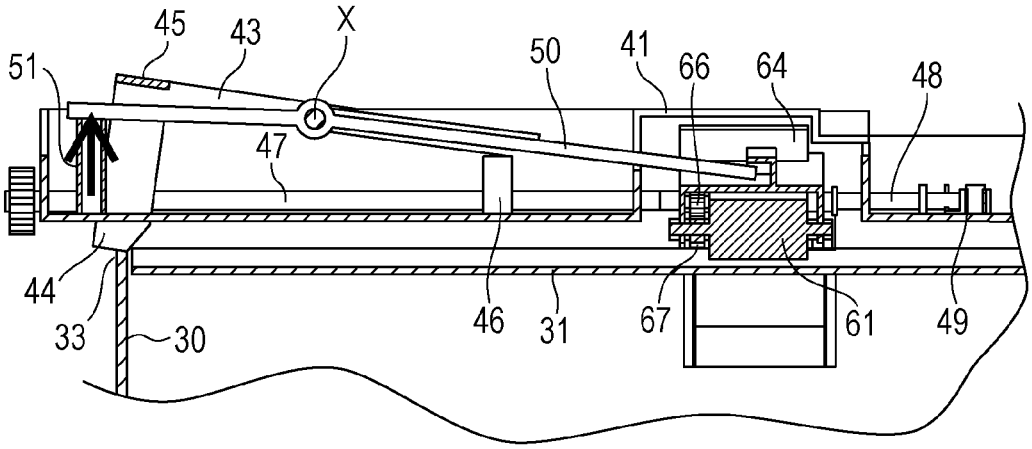
FIG. 5A is a partial sectional view taken in the VA-VA direction in FIG. 2B and illustrates a state in which a feeding cassette is inserted into a main body of the device.
Figure 5B:
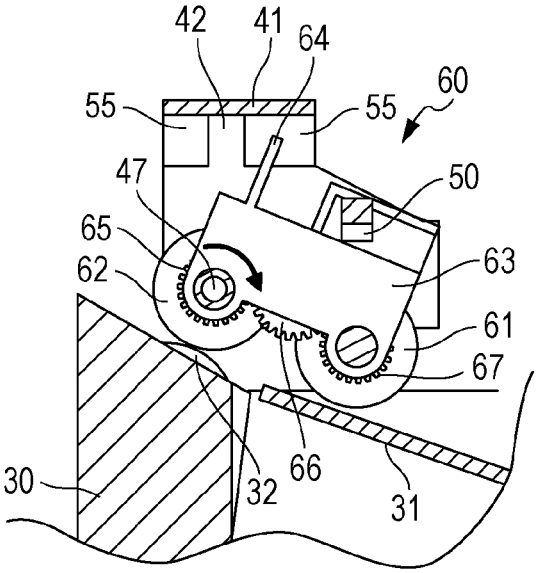
FIG. 5B is a partial cross-sectional view taken in the VB-VB direction in FIG. 2B and illustrates the state in which the feeding cassette is inserted into the main body of the device.

FIGS. 5A and 5B illustrate the body side feed unit 40 in a state in which the feeding cassette 30 is inserted into the main body of the device. FIG. 5A is a sectional view taken in the VA-VA direction in FIG. 2B and FIG. 5B is a cross-sectional view taken in the VB-VB direction in FIG. 2B.

The body side feed unit 40 is provided with the swing lever 50 that is swingable about a rotation center X. As illustrated in FIG. 5A, a compression spring 51 is provided on one end side of the swing lever 50. The compression spring 51 biases the swing lever 50 in the direction of the arrow in FIG. 5A (the upper direction). With the elastic force of the compression spring 51, the other end side of the swing lever 50 pushes the roller holder 63 downwards from above.

Furthermore, a lever 43 that is pivoted by interlocking with the inserting operation of the feeding cassette 30 being inserted into the main body of the device is provided in the body side feed unit 40. Same as the swing lever 50, the lever 43 is provided so as to be swingable about the rotation center X. A contacted portion 44 that is protruded downwards so as to come into contact with a contacting portion 33 of the feeding cassette 30 is provided on one end side of the lever 43. In the course of inserting the feeding cassette 30 into the main body of the device, the contacting portion 33 pushes the contacted portion 44 so that the lever 43 is pivoted. The contacting portion 33 is provided on one end (one end side) of the feeding cassette 30 in the axial direction of the pickup roller 61.

Furthermore, a push portion 45 that, in a state in which the feeding cassette 30 is drawn out, abuts against the swing lever 50 and that pushes the swing lever 50 downwards from above is provided on the side (the one end side) that is the same as the side of the contacted portion 44 of the lever 43. A spring (an elastic member) 46 is disposed on the other end side of the lever 43. The spring 46 elastically biases the lever 43 in an anticlockwise direction in FIG. 5A.

As illustrated in FIG. 5B, a restriction rib (a restriction portion) 64 that protrudes upwards is provided on the roller holder 63. A slit (a space) 42 that is capable of permitting the restriction rib 64 that is positioned at a permissive position to move in the axial direction and abutting portions 55 that abut against the restriction rib 64 when the restriction rib 64 that is positioned at a restrictive position moves in the axial direction are provided in the feed frame 41. In the first exemplary embodiment, when the restriction rib 64 is positioned at the restrictive position, the restriction rib 64 and an abutting portion 55 interferes with each other such that the feed roller unit 60 is prevented from coming off from the feed frame 41.

In the first exemplary embodiment, interlocked with the operation in which the feeding cassette 30 is inserted into and drawn out from the main body of the device, the restriction rib 64 moves between the restrictive position and the permissive position such that the relative positional relationship between the slit 42 and the restriction rib 64 changes. With the above, the state of the feed roller unit 60 changes between the state in which the feed roller unit 60 can be detached from the feed frame 41 and the state in which the feed roller unit 60 is restricted from coming off from the feed frame 41.

As illustrated in FIGS. 5A and 5B, in the course of inserting the feeding cassette 30 into the main body of the device, the contacted portion 44 is lifted upwards by the contacting portion 33 of the feeding cassette 30 and the lever 43 countering the elastic force of the spring 46 pivots in the clockwise direction in FIG. 5A. By pivoting of the lever 43, the push portion 45 of the lever 43 is separated from the swing lever 50. With the above, since the swing lever 50 does not receive force from the lever 43 anymore, the swing lever 50 pivots in the clockwise direction in FIG. 5A with the biasing force of the compression spring 51 and pushes down the roller holder 63. In other words, the roller holder 63 pivots in the direction of the arrow in FIG. 5B about the feed shaft 47 from an upper portion (a second position) to a lower portion (a first position). Furthermore, by interlocking with the operation in which the feeding cassette 30 is inserted into the main body of the device, the roller holder 63 is lowered from the second position to the first position and, accordingly, the pickup roller 61 is lowered to a position enabling the pickup roller 61 to feed the sheet S stacked on the stack plate 31. In such a state, the phases of the restriction rib 64 of the roller holder 63 and the slit 42 of the feed frame 41 are deviated with respect each other. In other words, in a state in which the feeding cassette 30 is inserted into the main body of the device, the restriction rib 64 is positioned at the restrictive position. Accordingly, even when force in the axial direction acts on the feed roller unit 60 during transportation and during jam recovery, since the restriction rib 64 and the abutting portion 55 of the feed frame 41 interfere with each other, the feed roller unit 60 can be prevented from coming off from the feed frame 41.

FIGS. 6A and 6B illustrate the body side feed unit 40 in a state in which the feeding cassette 30 is drawn out from the main body of the device. FIG. 6A is a sectional view taken in the VIA-VIA direction in FIG. 2B and FIG. 6B is a cross-sectional view taken in the VIB-VIB direction in FIG. 2B.

In a state in which the feeding cassette 30 is drawn out from the main body of the device, the lever 43 is biased in the anticlockwise direction in FIG. 6A with the spring 46; accordingly, the push portion 45 of the lever 43 pushes the swing lever 50 in the direction of the arrow in FIG. 6A. The spring pressure of the compression spring 51 that creates a moment that pivots the swing lever 50 in the clockwise direction is set smaller than the spring pressure of the spring 46 that creates a moment that pivots the lever 43 in the anticlockwise direction; accordingly, the swing lever 50 pivots in the anticlockwise direction. The swing lever 50 that pivots in the anticlockwise direction with the elastic force of the spring 46 pivots the roller holder 63 from the lower portion to the upper portion (lifts up the roller holder 63 in the direction of the arrow in FIG. 6B). In other words, the spring 46 elastically biases the restriction rib 64 to the permissive position.

In such a case, the phases of the restriction rib of the roller holder 63 and the slit 42 of the feed frame 41 coincide with each other. In other words, in a state in which the feeding cassette 30 is drawn out from the main body of the device, the restriction rib 64 is positioned at the permissive position. In such a state, since the restriction rib 64 and the feed frame 41 do not come into contact with each other when the feed roller unit 60 is moved in the axial direction, the feed roller unit 60 can be moved in the axial direction. Accordingly, the user can detach the feed roller unit 60 from the feed frame 41. Furthermore, interlocking with the operation in which the feeding cassette 30 is drawn out from the main body of the device, the roller holder 63 pivots about the feed shaft 47 from the lower portion (the first position) to the upper portion (the second position). Since the roller holder 63 is lifted up from the first position to the second position, the pickup roller 61 is lifted up so as to become separated from the sheet S stacked on the stack plate 31. With the above, the pickup roller 61 and the sheet S on the stack plate 31 can be prevented from interfering with each other when the feeding cassette 30 is drawn out.

As described above, according to the first exemplary embodiment, interlocked with the operation in which the feeding cassette 30 is drawn out from the main body of the device, the restriction rib 64 moves to the permissive position from the restrictive position. Furthermore, interlocked with the operation in which the feeding cassette 30 is inserted into the main body of the device, the restriction rib 64 moves to the restrictive position from the permissive position.

Accordingly, in a state in which the feeding cassette 30 is inserted into the main body of the device, even if a strong force in the axial direction is applied to the feed roller unit 60 during transportation of the main body of the device and during jam recovery, since the restriction rib 64 and the feed frame 41 interfere with each other, the feed roller unit 60 does not come off.

Furthermore, according to the first exemplary embodiment, unlike Japanese Patent Laid-Open No. 2009-286594 described above, when replacing the feed roller, the user does not have to move the lock member from the lock position to the lock release position; accordingly, usability while replacing the feed roller unit 60 is excellent.

Furthermore, in the first exemplary embodiment, interlocking with the operation in which the feeding cassette 30 is drawn out, the roller holder 63 pivots from the lower portion to the upper portion. Accordingly, when the user performs an operation of inserting and drawing out the feeding cassette 30 in and from the main body of the device, sliding contact between the sheet S and the pickup roller 61 can be reduced.

Note that in the description of the above-described first exemplary embodiment, a configuration in which the roller holder 63 holds the pickup roller 61 and the feed roller 62 in an integrated manner is described; however, the present disclosure is not to be limited to the above. The present disclosure may be configured so that a holder holding the pickup roller 61 and a holder holding the feed roller 62 are provided separately.

Note that in the description of the above described first exemplary embodiment, a configuration in which the feed roller unit 60 is replaced by the user moving the feed roller unit 60 in the axial direction is described; however, the present disclosure is not to be limited to the above. In other words, the moving direction to replace the feed roller unit 60 may be a direction other than the axial direction.

Second Exemplary Embodiment

A description of a second exemplary embodiment will be given next. Note that in the following description of the second exemplary embodiment, descriptions of the configurations and the operations common to those of the first exemplary embodiment will be omitted as appropriate.

Figure 7:
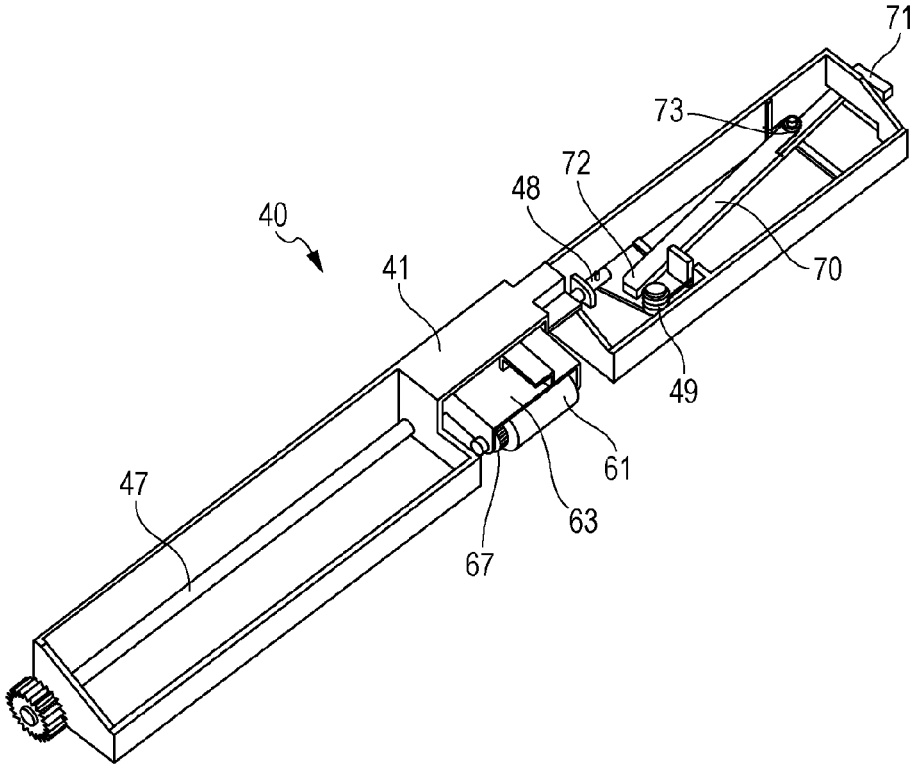
FIG. 7 is a perspective view of the feeding device of a second exemplary embodiment.

The body side feed unit 40 of the second exemplary embodiment is illustrated in FIG. 7. In a state in which the feeding cassette 30 is inserted into the main body of the device, the second exemplary embodiment includes a restriction lever (a restriction member) 70 that restricts the movement of the slide shaft 48 in the axial direction. In the first exemplary embodiment, the restriction rib 64 is provided in the feed roller unit 60; however, in the second exemplary embodiment, the restriction lever 70 is provided in the feed frame 41 (the main body of the device).

The restriction lever 70 is elastically biased in a direction moving away from the slide shaft 48 (the anticlockwise direction in FIG. 7) with a restriction spring 73. One end of the restriction lever 70 is a contacted portion 71 that comes into contact with a contacting portion 77 of the feeding cassette 30, and the other end is a restriction portion 72 that restricts the movement of the slide shaft 48 holding the feed roller unit 60. The contacting portion 77 is provided on one end (one end side) of the feeding cassette 30 in the axial direction of the pickup roller 61.

Figure 8A:
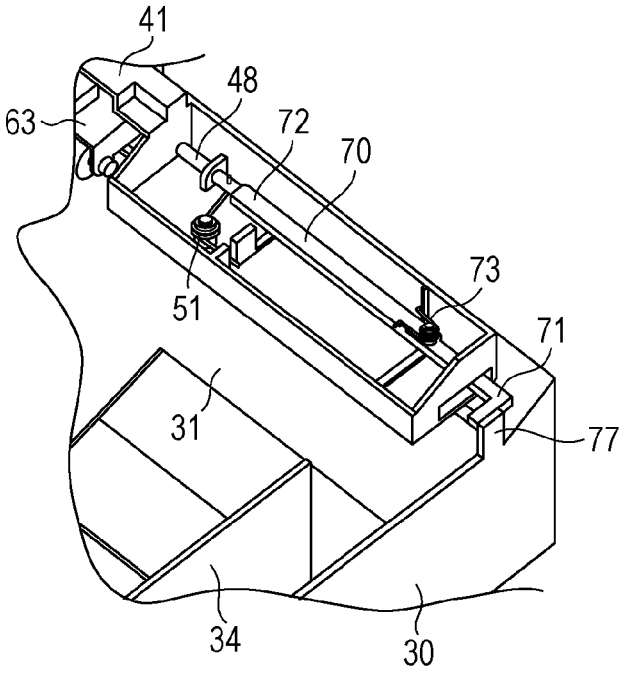
FIG. 8A is a perspective view illustrating a state in which the feeding cassette is inserted into the main body of the device.
Figure 8B:
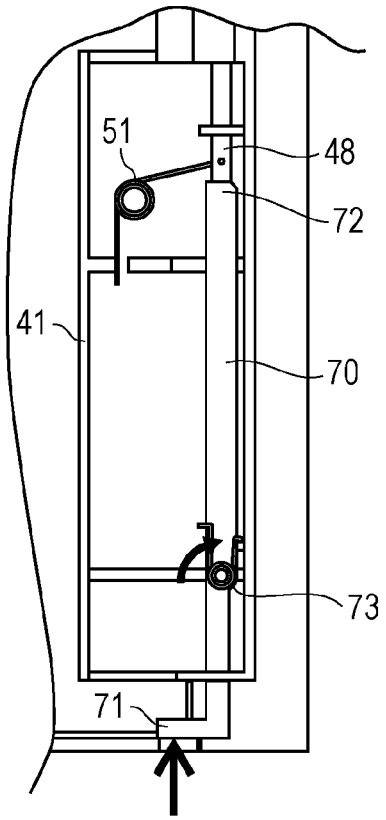
FIG. 8B is a top view illustrating the state in which the feeding cassette is inserted into the main body of the device.

FIGS. 8A and 8B illustrate the body side feed unit 40 in a state in which the feeding cassette 30 is inserted into the main body of the device. FIG. 8A is a perspective view and FIG. 8B is a top view.

In a state in which the feeding cassette 30 is inserted into the main body of the device, the contacted portion 71 of the restriction lever 70 is pushed by the contacting portion 77 of the feeding cassette 30 such that the restriction lever 70 receives a force in the direction of the arrow in FIG. 8B. With the above, the restriction lever 70, while countering the elastic force of the restriction spring 73, pivots in the clockwise direction in FIG. 8B and is moved to the restrictive position where the restriction portion 72 restricts the movement of the slide shaft 48 in the axial direction.

In the above state, since the slide shaft 48 and the restriction portion 72 interfere with each other, the feed roller unit 60 cannot be moved in the axial direction. Accordingly, in a state in which the feeding cassette 30 is inserted, the feed roller unit 60 cannot be attached or detached.

Figure 9A:
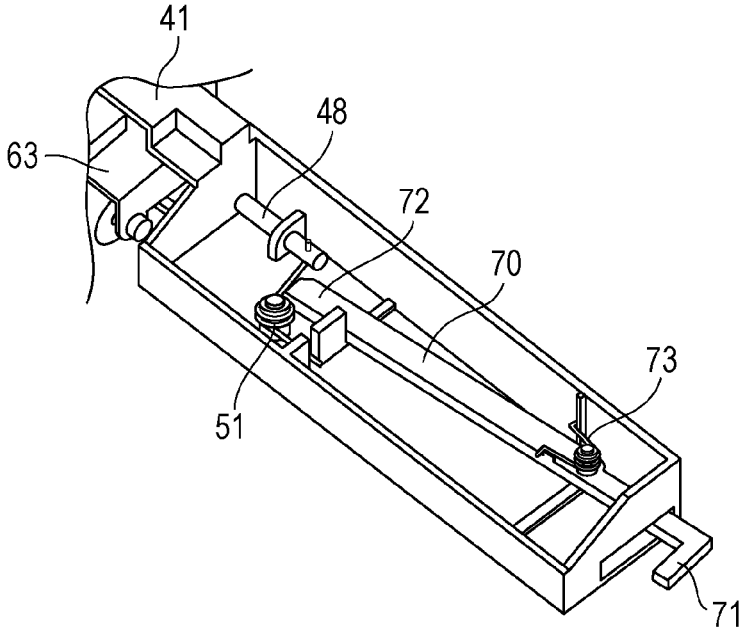
FIG. 9A is a perspective view illustrating a state in which the feeding cassette is drawn out from the main body of the device.
Figure 9B:
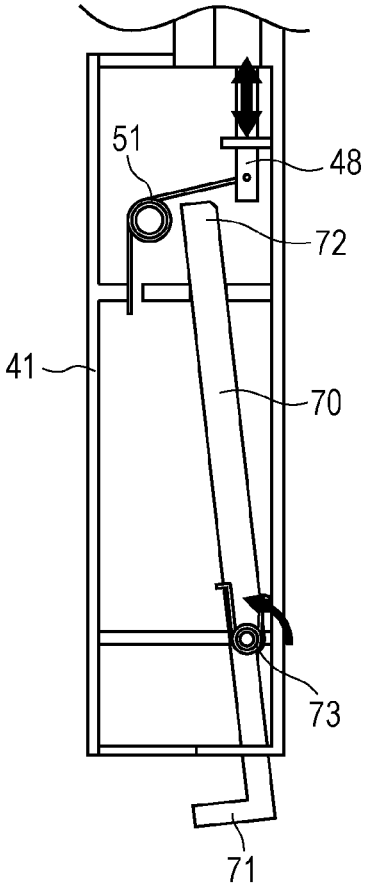
FIG. 9B is a top view illustrating the state in which the feeding cassette is drawn out from the main body of the device.

FIGS. 9A and 9B illustrate the body side feed unit 40 in a state in which the feeding cassette 30 is drawn out from the main body of the device. FIG. 9A is a perspective view and FIG. 9B is a top view.

In a state in which the feeding cassette 30 is drawn out from the main body of the device, the restriction lever 70 is pivoted in the anticlockwise direction in FIG. 9B with the elastic force of the restriction spring 73.

In the above state, the restriction portion 72 of the restriction lever 70 is positioned at the permissive position and is not restricting the motion of the slide shaft 48 in the axial direction. Accordingly, the user can move the feed roller unit 60 in the axial direction to replace the feed roller unit 60.

As described above, in the second exemplary embodiment as well, similar to the first exemplary embodiment, the restriction portion 72, interlocked with the operation in which the feeding cassette 30 is attached to and detached from the main body of the device, moves between the restrictive position and the permissive position. Accordingly, the feed roller can be prevented from coming off from the main body of the device other than when replacing the feed roller and the usability when replacing the feed roller can be improved.

Note that in the above description of the second exemplary embodiment, a configuration in which the movement of the slide shaft 48 is restricted with the restriction portion 72 of the restriction lever 70 is described; however, the present disclosure may be configured such that the motion of the feed roller unit 60 is directly restricted with the restriction portion 72 of the restriction lever 70.

Furthermore, in the above description of the first and second exemplary embodiments, an electrophotographic image forming process has been given as an example to describe the image forming portion that forms an image on a sheet; however, the present disclosure is not to be limited to one that uses the electrophotographic image forming process. For example, the image forming portion that forms an image on a sheet may be one that uses an inkjet image forming process that forms an image on a sheet by ejecting an ink liquid from a nozzle.

Furthermore, in the above-described first and second exemplary embodiments, a configuration in which the direction in which the feeding cassette 30 is inserted into the main body of the device is the direction orthogonal to the direction in which the pickup roller 61 feeds the sheet is described; however, the present disclosure is not to be limited to the above configuration. The present disclosure may be configured such that the feeding cassette 30 is inserted in a direction that is the same as the direction in which the pickup roller 61 feeds the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-115303, filed Jun. 3, 2014, which is hereby incorporated by reference herein in its entirety.

What is claimed is:

1. A feeding device that feeds a sheet, the feeding device comprising:

a support unit;

a stacking unit, on which a sheet is stacked, provided so as to be capable of being inserted into and drawn out from the support unit;

a feed roller that feeds a sheet stacked on the stacking unit; and a holding member that holds the feed roller, the holding member provided so as to be capable of being detached from the support unit by being moved in a predetermined direction, wherein, during an operation in which the stacking unit is drawn out from the support unit, the holding member concurrently moves to a second position from a first position such that the feed roller is lifted up, wherein, during an operation in which the stacking unit is inserted into the support unit, the holding member concurrently moves to the first position from the second position such that the feed roller is lowered, wherein the holding member includes a restriction portion that restricts the holding member from moving in the predetermined direction, wherein in a state in which the holding member is positioned at the first position, the restriction portion is positioned at a restrictive position where the holding member is restricted from moving in the predetermined direction, and wherein in a state in which the holding member is positioned at the second position, the restriction portion is positioned at a permissive position where the holding member is permitted to move in the predetermined direction.

2. The feeding device according to claim 1, wherein the predetermined direction is an axial direction of the feed roller.

3. The feeding device according to claim 1, further comprising an elastic member that elastically energizes the restriction portion towards the permissive position, wherein, during the operation in which the stacking unit is drawn out from the support unit, the restriction portion concurrently moves to the permissive position from the restrictive position with an elastic force of the elastic member, and wherein, during the operation in which the stacking unit is inserted into the support unit, the restriction portion countering the elastic force of the elastic member concurrently moves to the restrictive position from the permissive position.

4. The feeding device according to claim 1, further comprising a contacting portion that is provided in the stacking unit, and a contacted portion that is provided in the support unit and that comes into contact with the contacting portion, wherein the restriction portion is moved to the restrictive position from the permissive position when the contacting portion pushes the contacted portion in a course of inserting the stacking unit into the support unit.

5. The feeding device according to claim 1, wherein, during the operation in which the stacking unit is drawn out from the support unit, the holding member concurrently pivots to an upper portion from a lower portion such that the restriction portion moves to the permissive position from the restrictive position, and during the operation in which the stacking unit is inserted into the support unit, the holding member concurrently pivots to the lower portion from the upper portion such that the restriction portion moves to the restrictive position from the permissive position.

6. The feeding device according to claim 1, wherein the support unit includes a space that permits the restriction portion that is positioned at the permissive position to move in the predetermined direction and an abutting portion that abuts against the restriction portion when the restriction portion that is positioned at the restrictive position moves in the predetermined direction.

7. An image forming device forming an image on a sheet, the image forming device comprising:

a feeding device according to claim 1; and an image forming unit that forms an image on the sheet fed with the feeding device.

* * * * *